US005144828A

United States Patent [19]

Grotepass et al.

[11] Patent Number: 5,144,828

[45] Date of Patent: Sep. 8, 1992

[54] COMBINED LIGHT-SECTION MILL AND WIRE MILL

[75] Inventors: Johann Grotepass, Ratingen; Konrad Hamraths, Kaarst; Albert Hauck; Karl Keller, both of Hilchenbach; Hubert Müller, Grevenbroich, all of Fed. Rep. of Germany

[73] Assignee: SMS Schloemann-Siemag Aktiengesellschaft, Dusseldorf, Fed. Rep. of Germany

[21] Appl. No.: 696,190

[22] Filed: May 6, 1991

[30] Foreign Application Priority Data

May 4, 1990 [DE] Fed. Rep. of Germany ..... 4014411

[51] Int. Cl.[5] ..... B21B 1/16; B21B 31/10

[52] U.S. Cl. ..... 72/235; 72/238; 72/239; 29/123

[58] Field of Search ..... 72/203, 204, 234, 235, 72/237, 238, 239; 29/123, 125; 384/556; 403/11, 15, 31, 37; 411/432, 433, 434

[56] References Cited

U.S. PATENT DOCUMENTS

| | | | |
|---|---|---|---|
| 3,433,045 | 3/1969 | Wilson | 72/239 |
| 3,587,277 | 6/1971 | Pigni | 72/234 |
| 3,945,234 | 3/1976 | Steinbock | 72/238 |
| 3,995,353 | 12/1976 | Wilson | 29/125 |
| 4,423,612 | 1/1984 | Uppaluri | 72/237 |
| 4,650,364 | 3/1987 | Kark | 72/237 |
| 4,653,304 | 3/1987 | Feldmann et al. | 72/239 |
| 4,744,234 | 5/1988 | Poloni | 72/235 |

FOREIGN PATENT DOCUMENTS

| | | | |
|---|---|---|---|
| 256006 | 8/1967 | Austria . | |
| 0342178 | 2/1989 | European Pat. Off. . | |
| 2025640 | 10/1974 | Fed. Rep. of Germany . | |
| 3214411 | 12/1982 | Fed. Rep. of Germany | 72/235 |
| 3834606 | 4/1990 | Fed. Rep. of Germany . | |
| 0132451 | 11/1978 | Japan | 72/239 |
| 0049804 | 3/1985 | Japan | 72/238 |

OTHER PUBLICATIONS

Iron & Steel Engineer, Dec. 1984, pp. 23–27, Forni, L., "Roughing Mills with Cantilevered Rolls".

Iron & Steel Engineer, Jan. 1991, pp. 35–38, Roy C., "POSCO No. 3 Wire Rod Mill–A State of the Art Rolling Mill for the Quality Market".

*Primary Examiner*—Lowell A. Larson
*Assistant Examiner*—Thomas C. Schoeffler
*Attorney, Agent, or Firm*—Anderson, Kill, Olick

[57] ABSTRACT

A combined, continuously operating high-speed light-section and wire mill composed predominantly of so-called cantilever stands or CL stands with overhung-mounted collars. In the roughing train and in the intermediate train and/or in the finishing train, some rolling mill stands with a modular unti with double-mounted collars are arranged. A CL modular unit of the CL stands with overhung-mounted collars can be exchanged as required against a modular unit with double-mounted collars. The second bearing of the modular unit is arranged in a box stirrup which can be coupled to the gear box of the CL stand. The collar can be assembled and disassembled with an automatically actuated, preferably hydraulically acting quick fixing device which includes piston-cylinder units for clamping and releasing the collar on the shaft in axial and in radial direction. The modular unit is a roll box of sandwich construction with box plates which can be separated from each other.

23 Claims, 4 Drawing Sheets

COMBINED LIGHT-SECTION MILL AND WIRE MILL

BACKGROUND OF THE INVENTION

1. Field of the Invention

The present invention relates to a combined, continuously operating high-speed light-section mill and wire mill with a roughing train, at least one intermediate train and a subsequent finishing train, wherein each of the trains includes several rolling mill stands or rolling units, and possibly a subsequent finishing stand set.

2. Description of the Related Art

In accordance with German patent application P 39 40 236.5 which is not yet published, in a rolling mill train of the above-described type, it is proposed that the roll exchange takes place in accordance with the minimized series of passes in each train section. The exchange is carried out in the roughing train by means of crane tools, in the intermediate train by means of manipulators and in the finishing train by means of a quick-exchange device and possibly additional manipulators, wherein all rolling mill stands or rolling units in the individual train sections have overhung-mounted rolls which can be pulled out, in order to increase the availability and the yield of the rolling mill train.

Rolling mill stands with overhung-mounted collars are designated in the art as cantilever stands or abbreviated as CL stands. Thus, a particular feature of these modern compact stand constructions are the overhung-mounted or cantilevered roll shafts. Collars of highly wear-resistant materials ensure long pass service lives.

The vertical roll stands are driven from below. An intermediate gear unit is arranged between motor and stand. In vertical stands, the intermediate gear unit is a bevel gear unit and in horizontal stands the intermediate gear unit is a spur gear unit. In the stand itself, the drive shaft simultaneously drives the auxiliary shaft and one of the two roll shafts. The other roll shaft is driven through the auxiliary shaft. The drive shaft and the auxiliary shaft, as well as the roll shafts, are tempered to high strengths and ground. The roll shafts run in friction bearings which are mounted in rotatable eccentric bushings.

The collars are adjusted simultaneously. The adjustment is effected by rotating the eccentric bushing through an adjusting spindle having a thread with an oppositely directed pitch direction. The pass line remains constant. The axial forces occurring during rolling are absorbed by an inclined ball bearing which is mounted without axial play. As a result of this feature, and because the roll shafts are positioned exactly parallel to each other and rolling is carried out without twisting and without tension, a rolled product of high quality is obtained. The stand exchange times, i.e. the exchange times for the collars as well as the exchange times for the entire gear boxes including the collar, are so short that the stands are practically continuously ready for operation. Specially constructed looping stands are not necessary.

In a rolling mill train consisting of CL stands, the rolling pressure exerted by the material being rolled always is conducted into the first bearings of the overhung-mounted rolls. As a result, when rolling high initial pass cross-sections and with high deformation resistances, the collars, the bearings and the housings must have appropriately large dimensions. These large dimensions of the individual components of the stands result in the danger that the compact construction of the CL stands is essentially lost. Accordingly, large initial pass cross-sections and high rolling forces lead in the typical CL stands to technological and structural limits. This technical problem could be overcome by using conventional stands without posts and with rolls which are mounted on both sides in chocks, for example, stands with housing posts and with rolls with one or more passes which are mounted on both sides in the post windows in the chocks. However, these stands are expensive, require a large amount of space and intensive maintenance when the rolls are to be changed for other passes.

As a rule, the intermediate train and the finishing train of a wire mill and light-section mill equipped with CL stands is not capable of rolling sections because this can generally lead to dimensional inaccuracies due to the fact that the rolls are mounted in an overhung manner. If this were to be done nevertheless in the past, separate conventional rolling stands with the rolls being mounted on both sides would have to be introduced in the pitch line. This is an expensive and cumbersome solution because the rolling mill train is predominantly to be used for wire and round steel dimensions.

SUMMARY OF THE INVENTION

Therefore, it is the object of the invention to further develop and improve a rolling mill train composed of CL stands, so that the rolling mill stand can roll material with high initial pass cross-sections and with high deformation resistances and possibly also rolled sections, while requiring relatively low costs and short reassembly operations.

Another object is to provide an improved arrangement for supporting and quickly and essentially automatically exchanging the collars and stands.

In accordance with the present invention, the combined high-speed light-section mill and wire mill of the above-described type includes in the roughing train as well as in the intermediate train and/or the finishing train of a rolling mill train composed essentially of CL stands with overhung-mounted collars several rolling mill stands with a modular unit including double-mounted collars.

The features of the invention make it possible in an advantageous manner to be able to carry out high initial pass cross-sections with high rolling forces even in those wire mills and light-section mills which are exclusively equipped with so-called CL stands; this is particularly true if the first CL stands in the roughing train are arranged with a modular unit with double-mounted collars. In addition, if several rolling mill stands with the modular unit with double-mounted collars are arranged in the intermediate train and in the finishing train, it is also possible if necessary to roll sections of smaller lot sizes economically and with relatively minor reassembly operations. Consequently, the rolling mill train which is composed mostly of CL stands is very flexible with respect to the variety of products to be rolled and can be quickly adapted to the products required by the marketplace.

In accordance with a further development of the invention, in several stands in the roughing train and in the intermediate train and/or in the finishing train, the CL modular unit with overhung-mounted collars can be replaced by a modular unit with double-mounted collars. The box or frame unit with the double-mounted collars can be selected instead of the CL modular unit with unilaterally mounted rolls as required and in order to adapt it to the initial pass cross-sections. All gear units, drive units, and housing units of the CL stands in the rolling mill train can also be used in the unit with the double-mounted collars. Accordingly, it is also possible to use box or frame types or box or frame sizes with different axis spacings. Particularly in the intermediate train and in the finishing train, the modular unit with double-mounted collars for manufacturing sections does not have to be part of the initial equipment of the rolling mill train, but may be added later as necessary. The CL modular unit with unilaterally mounted collars can be exchanged in a simple manner with a modular unit having double-mounted collars if sections are to be produced in small lot sizes, for example, to increase the variety of products.

In accordance with a further development of the invention, the modular unit with double-mounted collars can be used for two-strand finishing rolling of split round material, i.e., separately rolled round material, for example, for producing concrete reinforcing bar steel. In this case, the collars are provided with two passes. In addition, it is advantageous to provide a horizontal/vertical arrangement of the overhung-mounted collars and the double-mounted collars between the stands, so that twisting between the stands particularly of rolled round material is avoided.

When the collars have to be exchanged because of wear of the passes or because different sections are to be rolled, this exchange can be carried out in two different ways: either by exchanging the modular unit with an already preassembled modular unit as described above or, in accordance with another further development of the invention, by exchanging the collars; in this case, it is necessary to construct the second bearing of the shaft supporting the collar in such a way that with relative little maintenance the collars can be pulled off essentially automatically. For this purpose an automatically actuated, preferably hydraulically acting fastening arrangement for the double-mounted collars is proposed. The fastening arrangement includes at least one piston-cylinder unit acting on at least one end face of the collar in order to clamp and release the collar in axial direction and at least one additional piston-cylinder unit acting on the collar for clamping and releasing in radial direction a conical bushing which supports the collar and is displaceably mounted on the shaft axis of the collar. It is advantageous in this connection that the modular unit with double-mounted collar includes a box stirrup which contains the second bearing and is arranged on the gear box which contains the first bearing. The box stirrup is composed of two stirrup parts which can be connected by a quickly releasable coupling. The eccentric bushings of the bearings of the shaft supporting the collars are positively connected by means of another connecting element, so that synchronous rotation of the eccentric bushings is ensured. The new rolls and the new roll fittings are adjusted to the new pitch line by means of the positively connected eccentric bushings.

The advantage of the structural configuration of the fastening arrangement according to the invention for the double-mounted collars of the modular unit shall now be described.

If the overhung-mounted collars of the CL stands are to be exchanged either in the roughing train or in the finishing stands of the intermediate train or of the finishing train against a double-mounted collar, the entire modular box is exchanged. The box exchange and the exchange of the collars can be carried out with the proposed construction essentially automatically and within a very short time. Accordingly, the rolling mill train can be equipped depending on the type of application in an inexpensive manner either completely with CL stands or in the roughing train with several stands with modular units with double-mounted collar supports and in the intermediate train and in the finishing train either as the initial equipment or later with modular unit with double-mounted collars for rolling sections and for separate rollings.

In accordance with another feature of the invention, the modular unit with an exchangeable roll box is of sandwich construction and consists essentially of two box plates which support single-piece collar shafts and the support units and adjusting units therefor, wherein the box plates have coupling members which project from the ends and are directed toward each other.

In accordance with another possible feature of the invention, the front plate of the roll box may be separately exchangeable, or possibly together with the collars and/or with the roll fittings. Since, in this case, the front plate is separately exchangeable, the collar cooling system and other hydraulic connections can be advantageously arranged at the box plate which can be connected to the gear box.

The sandwich construction of the roll box described above makes it possible, in accordance with another further development of the invention, to fasten the collars to the collar shaft in a simple manner in that the collars are seated on a conical bushing which is slid onto the collar shaft and to which for clamping and releasing the collars the axial pressure of a hydraulic nut is applied. The collars are advantageously mounted in axial direction between annular clamping members which rest with a friction disk connection to the sides of the collars; the clamping members are preferably splined to the conical bushing or the collar shaft.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
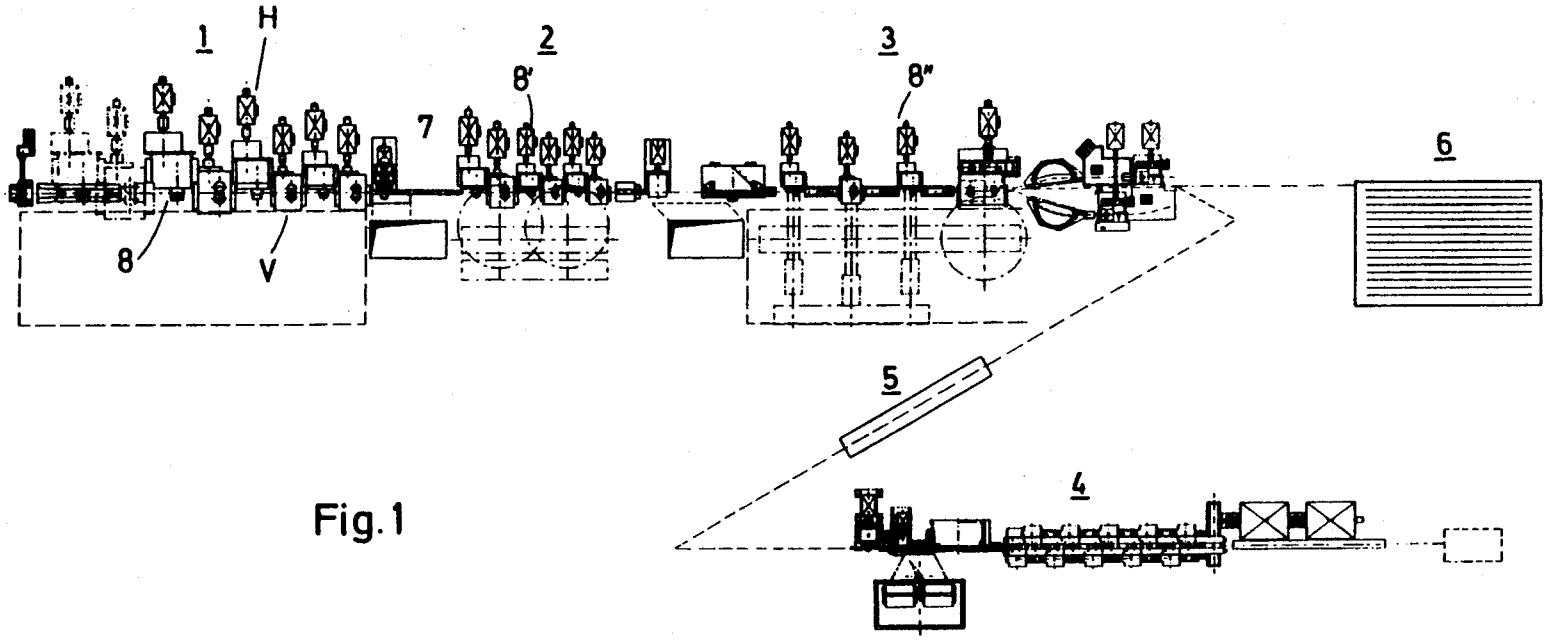
FIG. 1 is a schematic illustration showing the layout of a rolling mill train.

FIG. 1 of the drawing shows a combined ad continuously operating high-speed light section mill and wire mill which includes a roughing train 1 composed of rolling mill stands which are arranged next to each other in the pitch line with a stand sequence of horizontal (H)/vertical (V). The roughing train 1 is followed by the intermediate train 2 which is also composed of rolling mill stands arranged next to each other with the stand sequence of horizontal (H)/vertical (V). A finishing train 3 is arranged following the intermediate train 2. The finishing train 3 which is the intermediate train when wire is manufactured is followed by a finishing stand set 4 with a cooling unit which is not shown in detail and which usually consists of a water cooling section with driver and coiling unit and the Stelmor unit. When rod steel or sections are being manufactured, the finishing train 3 is followed by a cooling and run-out bed 6.

The complete rolling mill train is composed predominantly of so-called cantilever stands or CL stands for short, i.e., stands with unilaterally or overhung-mounted collars. The rolling mill train is special in that particularly the first CL stands in the roughing train contain exchangeable box units which can be exchanged against units with double-mounted collars. All gear units, drive units and housing units, not shown in detail, of the CL stands in the rolling mill train can be used in the box with the double-mounted collars.

When the collars are mounted in the above-described manner, it is made possible especially in the first stands of the roughing train to roll material with high pass cross-sections and high deformation resistances while providing excellent quality. If necessary, several rolling mill stands each being a modular unit 8', 8'' with double-mounted collars 10 can be arranged in the intermediate train 2 or in the finishing train 3 for manufacturing sections. Since in the intermediate train and in the finishing train it is also possible to use all gear units, drive units and housing units of the CL stands in the rolling mill train, the modular unit 8', 8'' for the manufacture of sections does not have to be part of the initial equipment of the rolling mill train. Rather, the CL modular unit with overhung-mounted collars can be exchanged as necessary against a modular unit 8', 8'' with double-mounted collars 10.

Figure 2:
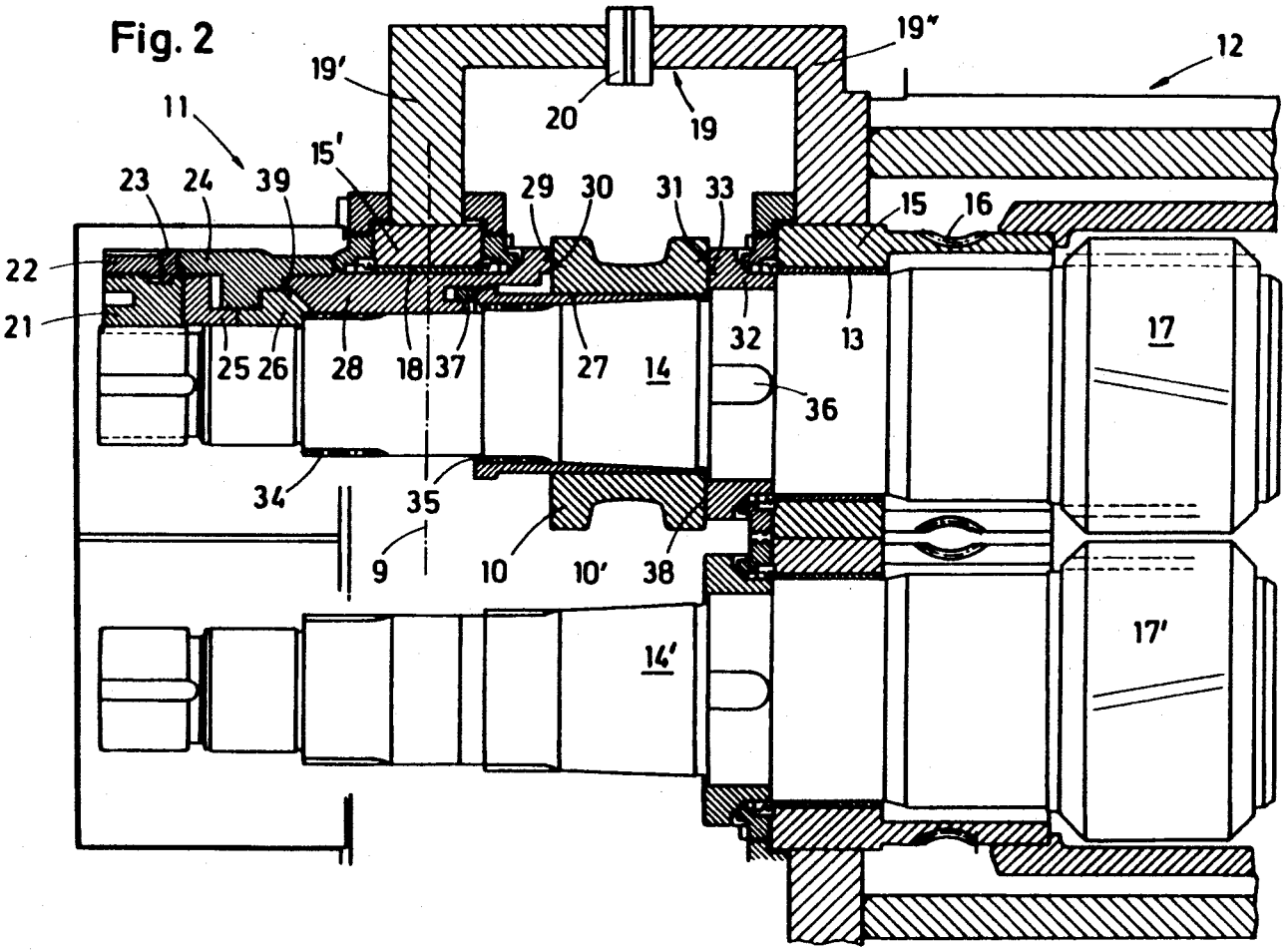
FIG. 2 is a partially sectional view of the quick fixing device for the double-mounted collars of a modular unit.

FIG. 2 of the drawing shows the fastening arrangement for the double-mounted collar 10 of an appropriate modular unit in the roughing train and in the intermediate train or in the finishing train. The fastening arrangement 11 is arranged on the gear box 12. The first bearing 13, preferably a multiple-layer friction bearing of the shaft 14 of the collar 10, is mounted in an eccentric bushing 15 which can be rotated through an adjusting spindle, not shown, by means of a worm thread 16. This makes it possible to adjust the pass opening of the collar. The shafts 14, 14' supporting the collars 10, 10' are driven by means of spur gears 17, 17' which, in turn, are driven by an intermediate gear unit, not shown. The second bearing 18 of the collar 10 is also a multiple-layer friction bearing which is mounted in an eccentric bushing 15'. The second bearing 18 and the eccentric bushing 15' are mounted in a box stirrup 19 which is connected with the gear box 12, for example, by means of a screw connection. The box stirrup 19 is composed of two stirrup parts which are held together by means of a coupling 20. The eccentric bushings 15 and 15' of the first bearing 13 and of the second bearing 18 are positively connected to each other in the known manner, so that a synchronized rotation of the eccentric bushings by means of the adjusting spindle which meshes with the worm thread 16 is ensured.

The elements for pulling off and assembling the fastening arrangement 11 for the collars 10 including the entry and exit fittings, not shown, are described as follows beginning with the end of the shaft 14:

A thrust nut 21 with a retaining nut 22. A support ring 23 which is arranged between the retaining nut 22 and a cylinder part 24. Two ring-shaped pistons 25, 26 are arranged in the cylinder part 24. The pistons are a clamping piston 25 for the collar 10 and a releasing piston 26 for the conical bushing 27 on which the collar 10 is mounted. The cylinder part 24 is connected in a positively engaging manner and in a frictionally engaging manner with a support sleeve whose support surface 29 rests against a side surface 30 of the collar 10. The second multiple-layer friction bearing 18 is arranged on the support sleeve 28 and is surrounded by the eccentric bushing 15'. As mentioned, the eccentric bushing 15' is arranged in the box stirrup 19. A stop ring 32 with a stop surface 33 is located between the first friction bearing 13 and the eccentric bushing 15 and the other side surface 31 of the collar 10. Thin friction disks 38 for torque transmission are inserted between the support surfaces of support sleeve 28 and collar 10 and between the support surfaces of the stop ring 32. The stop ring 32, the conical bushing 27 and the support sleeve 28 are arranged in a positively engaging manner in circumferential direction on the shaft 14 which supports the collar 10, preferably by means of longitudinal toothing 34, 35 or the stop ring with an adjusting spring 36. An annular piston 37 is located in the support sleeve 28. The annular piston 37 rests against the conical bushing 27 in order to clamp the conical bushing against the collar.

Figure 3:
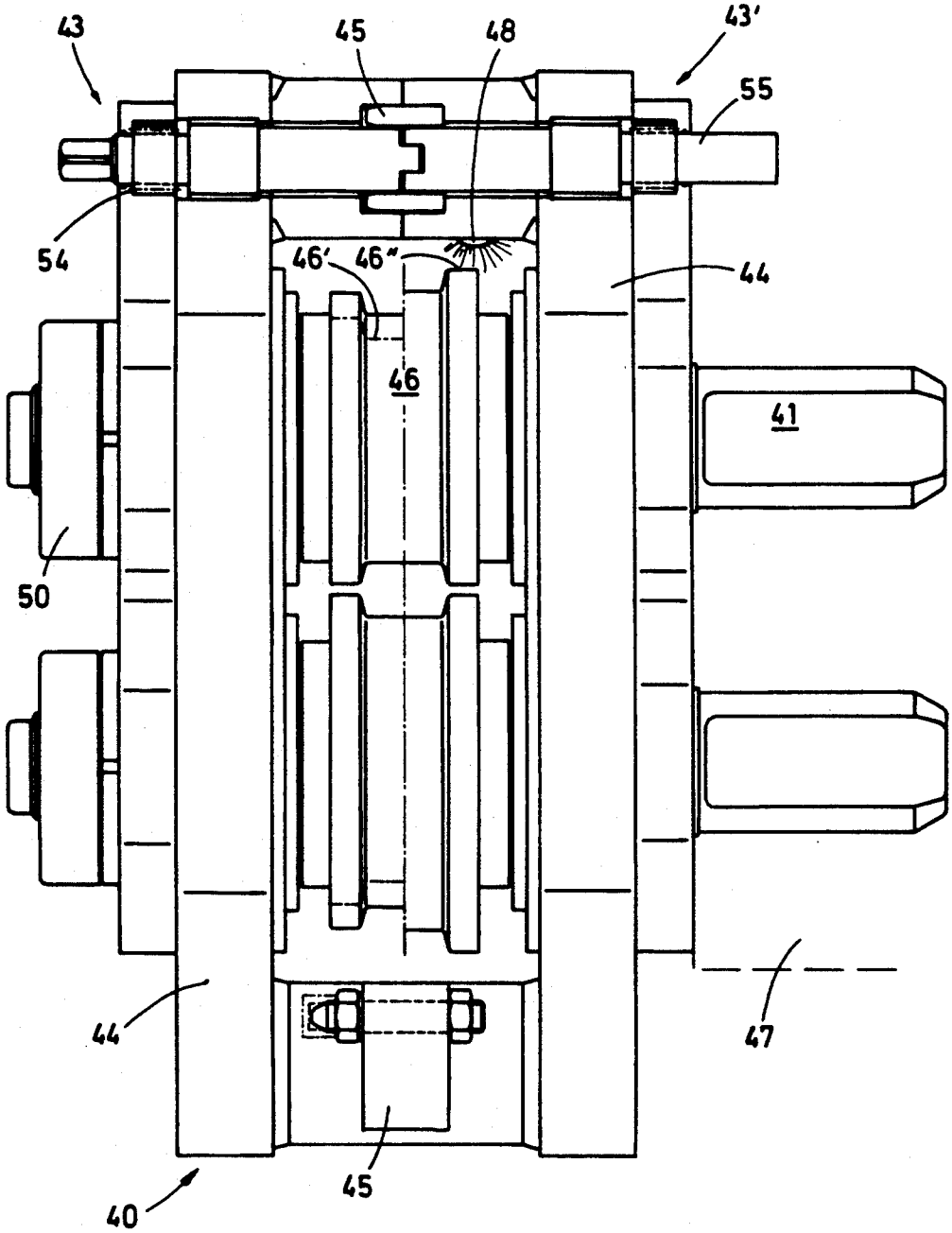
FIG. 3 is a schematic illustration of the modular unit in the form of roll box in sandwich construction.
Figure 4:
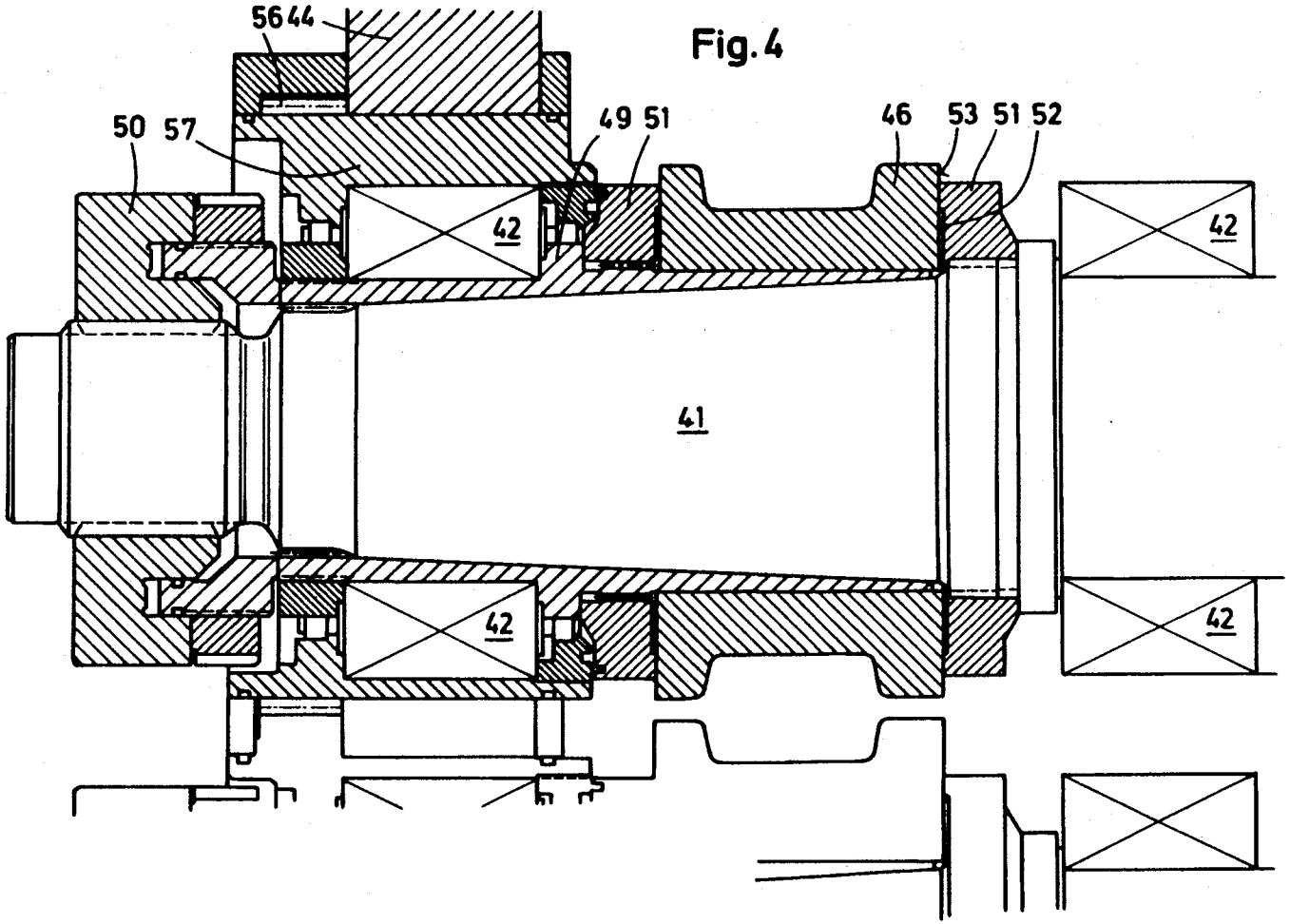
FIG. 4 shows a detail, partly in section, of the roll box of FIG. 3.

FIGS. 3 and 4 of the drawing show another modular unit with an exchangeable roll box 40 of sandwich construction. The roll box includes two box plates 44 with two coupling members 45 which extend at an angle from the ends of the plate 44 and are directed toward each other. The collar shafts 41 are mounted in bearings 42 in the box plates. The shaft ends of the collar shafts 41 can be inserted in gear boxes 47, not illustrated in detail. A hydraulic nut 50 can be seen at the other shaft end of the collar shaft 41. Hydraulic nut 50 is used for fastening the collar 46 on the shaft 41 in radial direction by means of a conical bushing 49 slid onto the collar shaft. The adjusting unit 43 for adjusting the collars 46 to the respective pass openings is arranged on the outer sides of the box plates 44.

A hand wheel, not shown, can be slid onto the split shaft 55. The hand wheel rotates a pinion 54 shown in FIG. 3. The pinion 54 acts through at least one additional intermediately arranged spur gear, not shown, on the eccentric bushing 57, shown in FIG. 4, which is provided with an external toothing 56. The bearing units for the collar shaft which are self-aligning roller bearings in this case are arranged in the eccentric bushing 57. On the gear unit side, the eccentric bushing 57 is connected in a positive manner by means of the connecting shaft 55 to the other adjusting unit 43 which is arranged on that box plate 44 which faces the gear box 47. For simplicity's sake, FIG. 4 only shows the additional bearing unit 42 composed of self-aligning roller bearings; the eccentric bushing which receives the self-aligning roller bearings 42 is of identical construction as the eccentric bushing 57 which is illustrated with respect to the box front plate 44.

FIG. 3 further shows that the entire roll box 40 can be pulled off from the gear box 47 and can be replaced by a new box, possibly by another type of box, or by a box having a different size with different spacings between the axes. However, FIG. 3 also shows that the box front plate 44 of the roll box 40 can be exchanged separately if necessary, possibly with the collars 46 and/or the roll fittings. For this purpose, the screws of the coupling member 45 are loosened or removed and the hydraulic nut 50 untightened and released. Since the collar 46 is seated on the conical bushing 49, the collar 46 is also pulled off from the collar shaft when the box front plate is removed. The collar 46 is then easily accessible and can be pulled off from the conical bushing 49 and replaced by a new collar. This substantially reduces the maintenance period for the roll box and the exchange times required for the collars. This is particularly true if the collar cooling unit 48 and other hydraulic connections remain on that box plate 44 which can be connected to the gear box 47, as shown in FIG. 3. Different diameters of collars which can be exchanged are denoted by reference numerals 46' and 46''.

As described above, collars 46 are mounted on a conical bushing 49 which is slid onto the collar shaft 41, wherein the axial pressure of the hydraulic nut 50 acts in radial direction on the conical bushing 49 for clamping and releasing the collars. It is assumed that the manner of operation of the hydraulic nut 50 is known in the art. To ensure that the collars 46 are not only secured in radial direction on the collar shaft 41, but also in axial direction and in circumferential direction, the collars are held between annular clamping members 51, wherein friction disks 52 are placed as connecting elements between the clamping members 51 and the sides 53 of the collars, and wherein additionally the clamping members 51 as splined to the conical bushing 49 or on the other side to the collar 41.

While a specific embodiment of the invention has been shown and described in detail to illustrate the application of the inventive principle, it will be understood that the invention may be embodied otherwise without departing from such principles.

We claim:

1. In a combined, continuously operating high-speed light-section mill and wire mill with a roughing train, at least one intermediate train and a subsequent finishing train, wherein each of the trains includes several rolling mill stands, the improvement comprising the roughing train and the intermediate train and the finishing train of the rolling mill including CL stands with overhung-mounted collars, and the roughing train and the intermediate train and the finishing train including stands each comprising a modular unit with double-mounted collars.

2. The combined light-section mill and wire mill according to claim 1, wherein the collars of the modular unit have one pass.

3. The combined light section mill and wire mill according to claim 1, wherein the collars of the modular unit have two passes.

4. The combined light-section mill and wire mill according to claim 1, comprising a rolling unit comprising a plurality of modular units with double-mounted collars, the modular units begin arranged alternatingly horizontally and vertically.

5. The combined light-section mill and wire mill according to claim 1, wherein a plurality of stands in the roughing train and in the intermediate train and in the finishing train have a CL modular unit with overhung-mounted collars, wherein each CL modular unit is replaceable by a modular unit with double-mounted collars.

6. The combined light-section mill and wire mill according to claim 5, wherein each modular unit with double-mounted collars in the finishing train includes means for rolling two strands of previously separated round material.

7. The combined light-section mill and wire mill according to claim 5, wherein each modular unit with double-mounted collars includes a box stirrup, each box stirrup being arranged on a gear box which contains a first bearing for the collars, the box stirrup comprising two stirrup parts connected by means of a coupling.

8. The combined light-section mill and wire mill according to claim 7, comprising an automatically actuated, hydraulically acting fastening arrangement for the double-mounted collars, the fastening arrangement including at least one first piston-cylinder unit acting on an end face of the collar, the at least one firs piston-cylinder unit being configured to clamp and release the collar in axial direction, and at least one second piston-cylinder unit acting on the collar, the at least one second piston-cylinder unit being configured to clamp and release a conical bushing in radial direction, the conical bushing supporting the collar and being arranged on a shaft of the collar.

9. The combined light-section mill and wire mill according to claim 8, wherein the second bearing of the collar is supported by a support sleeve, the support sleeve being slidably arranged on the shaft of the collar, the conical bushing having an end face, the end face of the conical bushing being connected by means of the second piston-cylinder unit to the support sleeve, further comprising means for frictionally engaging the support sleeve with a side surface of the collar.

10. The combined light-section mill and wire mill according to claim 9, comprising means for frictionally engaging another side surface of the collar with a stop ring which surrounds the shaft of the collar.

11. The combined light-section mill and wire mill according to claim 10, wherein the support sleeve has two support surfaces, a friction disk each being arranged between the support surfaces of the support sleeves and the collar and between the side surfaces of the stop ring and the collar.

12. The combined light-section mill and wire mill according to claim 11, wherein the support sleeve has an end face opposite the two support surfaces, the end face of the support sleeve being connected to a cylinder part, a piston for clamping the collar and a piston for releasing the conical bushing being slidingly arranged in the cylinder part, wherein the pistons are annular pistons and are seated on the shaft of the collar.

13. The combined light-section mill and wire mill according to claim 12, comprising means for tightening the cylinder part relative to the support sleeves and relative to the conical bushing of the shaft of the collar, the means for tightening the cylinder part including a retaining nut, the retaining nut threadingly engaging the shaft of the collar for applying tightening forces.

14. The combined light-section mill and wire mill according to claim 13, comprising means for positive connecting the stop ring, the conical bushing and the support sleeve on the shaft of the collar.

15. The combined light-section mill and wire mill according to claim 14, wherein the stop ring, the conical bushing and the support sleeves are splined to the shaft of the collar.

16. The combined light-section mill and wire mill according to claim 14, wherein the stop ring, the conical bushing and the support sleeves are connected to the shaft of the collar by means of an adjusting spring.

17. In a combined, continuously operating high-speed light-section mill and wire mill with a roughing train, at least one intermediate train and a subsequent finishing train, wherein each of the trains includes several rolling mill stands, the improvement comprising the roughing train and the intermediate train and the finishing train of the rolling mill including CL stands with overhung-mounted collars, and the roughing train and the intermediate train and the finishing train including stands each comprising a modular unit with double mounted collars, and wherein the modular unit is constructed with an exchangeable roll box, the roll box comprising two box plates for supporting tow at least single piece collar shafts, the box plates receiving bearing units and adjusting units for the collar shafts, wherein each box plate includes a coupling member, the coupling member facing toward each other and extending at an angle form end of box plates.

18. The combined light-section mill and wire mill according to claim 17, wherein one of the box plates is separately exchangeable.

19. The combined light-section mill and wire mill according to claim 17, wherein the collars include roll fittings, and wherein one of the box plates is separately exchangeable together with the collars and the roll fittings.

20. The combined light-section mill and wire mill according to claim 17, wherein a collar cooling unit and other hydraulic connections are connected to one of the box plates.

21. The combined light-section mill and wire mill according to claim 17, comprising a conical bushing supporting the collars, a conical bushing being mounted on each collar shaft, further comprising means for applying an axial pressure of a hydraulic nut on each conical bushing for clamping and releasing the collars in radial direction.

22. The combined light-section mill and wire mill according to claim 21, comprising annular clamping members for holding the collars therebetween, the clamping members resting through a friction disk connection against side surfaces of the collars and being splined to the conical bushing.

23. The combined light-section mill and wire mill according to claim 21, comprising annular clamping members for holding the collars therebetween, the clamping members resting through a first section disk connection against side surfaces of the collars and being splined to the collar shafts.

* * * * *